US007431022B1

(12) United States Patent
Xia et al.

(10) Patent No.: US 7,431,022 B1
(45) Date of Patent: Oct. 7, 2008

(54) EVAPORATIVE EMISSION CANISTER PURGE ACTUATION MONITORING SYSTEM

(75) Inventors: Zhouxuan Xia, Windsor (CA); Kevin Mulkeran, Holly, MI (US); Wing Chan, Novi, MI (US); Hans Jensen, West Bloomfield, MI (US)

(73) Assignee: Mahle Technology, Inc., Farmington Hills, MI (US)

( * ) Notice: Subject to any disclaimer, the term of this patent is extended or adjusted under 35 U.S.C. 154(b) by 0 days.

(21) Appl. No.: 11/880,781

(22) Filed: Jul. 24, 2007

(51) Int. Cl.
*F02M 37/04* (2006.01)

(52) U.S. Cl. ..... 123/520; 123/198 D

(58) Field of Classification Search ..... 123/520, 123/519, 518, 516, 198 D, 458, 494
See application file for complete search history.

(56) References Cited

U.S. PATENT DOCUMENTS

| | | | | | |
|---|---|---|---|---|---|
| 4,703,737 | A | | 11/1987 | Cook et al. | 123/520 |
| 5,317,909 | A | * | 6/1994 | Yamada et al. | 73/118.1 |
| 5,383,437 | A | | 1/1995 | Cook et al. | 123/520 |
| 5,437,257 | A | * | 8/1995 | Giacomazzi et al. | 123/520 |
| 5,474,050 | A | | 12/1995 | Cook et al. | 123/520 |
| 5,635,630 | A | * | 6/1997 | Dawson et al. | 73/40.5 R |
| 6,009,746 | A | * | 1/2000 | Cook et al. | 73/49.7 |
| 6,016,793 | A | * | 1/2000 | Cook et al. | 123/520 |
| 6,073,487 | A | | 6/2000 | Dawson | 73/118.1 |
| 6,192,743 | B1 | * | 2/2001 | Perry | 73/40 |
| 6,253,598 | B1 | | 7/2001 | Weldon et al. | 73/40 |
| 6,282,945 | B1 | | 9/2001 | Weldon et al. | 73/40 |
| 6,378,510 | B1 | | 4/2002 | Green et al. | 123/568.27 |
| 6,405,718 | B1 | * | 6/2002 | Yoshioka et al. | 123/520 |
| 6,779,512 | B2 | * | 8/2004 | Mitsutani | 123/519 |
| 6,823,850 | B1 | | 11/2004 | Hurley | 123/518 |
| 6,832,509 | B2 | * | 12/2004 | Morinaga et al. | 73/118.1 |
| 7,047,950 | B2 | | 5/2006 | Hurley | 123/516 |
| 7,216,636 | B2 | | 5/2007 | Hurley | 123/519 |
| 2003/0005915 | A1 | * | 1/2003 | Mitsutani | 123/674 |

* cited by examiner

*Primary Examiner*—Carl S Miller
(74) *Attorney, Agent, or Firm*—Bliss McGlynn, P.C.

(57) ABSTRACT

An evaporative emission canister purge actuation monitoring system includes an integrated valve body having a main flow passage, a first one-way umbrella valve mounted to the valve body that is responsive to predetermined positive pressure in the main flow passage to control flow of fluid from a vapor canister to ambient air as well as a second one-way umbrella valve that is responsive to a predetermined negative pressure in the main flow passage to control the flow of ambient air through a fresh air port. A vacuum actuated switch is supported by the integrated valve body and in electrical communication with a control unit. The switch is responsive to negative pressure in the main flow passage to send a signal indicative of the predetermined negative pressure to the control unit.

7 Claims, 6 Drawing Sheets

EVAPORATIVE EMISSION CANISTER PURGE ACTUATION MONITORING SYSTEM

BACKGROUND OF THE INVENTION

1. Field of the Invention

The present invention is directed toward an evaporative emission canister purge actuation monitoring system for a motor vehicle having a vapor canister, an engine, and at least one control unit.

2. Description of the Related Art

Automotive vehicles include fuel delivery systems having a fuel tank and fuel delivery lines. The fuel delivery lines typically include a plurality of conduits and associated connections operatively interconnecting the fuel tank with an internal combustion engine. A fuel pump is used to deliver the fuel under pressure from the tank to the engine via the fuel delivery lines. Many automotive vehicles are powered using gasoline as fuel. Gasoline is a volatile substance that generates gasses that, if untreated, are harmful to the environment. These gasses are generally referred to as evaporative emissions. Because they are gasses, these emissions can escape from the fuel system even through very small orifices that may present themselves throughout the fuel delivery system. Accordingly, various governmental authorities in countries throughout the world have long mandated that automotive vehicles include systems for preventing the release into the atmosphere of untreated or un-combusted fuel vapor generated in the fuel delivery system.

Thus, gasoline powered automotive vehicles typically include evaporative emission control systems that are designed to effectively deal with the evaporative emissions. Such systems typically include a vapor canister operatively connected in fluid communication with the fuel tank and the intake of the internal combustion engine. The vapor canister typically includes carbon or some other absorbent material that acts to trap the volatile evaporative emissions generated by the fuel system. A canister purge valve controls the flow of evaporative emissions between the canister and the intake of the engine. In turn, the operation of the canister purge valve is typically controlled by an onboard computer, such as the engine control module, or the like. During normal vehicle operation, and subject to predetermined operational characteristics, the canister purge valve is opened to subject the vapor canister to the negative pressure of the engine intake manifold. This purges the vapor canister of trapped gaseous emissions, effectively regenerating the canister so that it may absorb additional vapor.

During vehicle shutdown, the canister purge valve is closed and the evaporative emissions generated in the fuel system are routed from the fuel tank to the vapor canister where they are absorbed and stored for later purging as described above. During vehicle shutdown, the fuel system is effectively sealed from the ambient environment.

In addition to conventional evaporative emission control systems as described above, many governmental authorities have further mandated that these systems have self-diagnostic capabilities to determine if any leaks are present in the closed fuel system. As public concern over pollution has risen, some governmental authorities have promulgated tougher standards for automotive evaporative emission control systems. For example, the California Air Resource Board (CARB) now requires evaporative emission systems to detect leaks as small as 0.020 inches in diameter. Many of these systems employ sensors adapted to detect the presence of a vacuum that is naturally generated in the emission space of the fuel tank after shutdown and after the fuel system has cooled. Other known evaporative emission systems employ positive or negative pressure generated by some related system to test the sealed integrity of the fuel system.

While on-board diagnostic evaporative emission systems of the type proposed in the related art have generally worked for their intended purposes they have also suffered from the disadvantage of being relatively complex and costly. They also generally consist of a number of components which must be separately controlled and interconnected via flexible or hard conduits sometimes referred to as "on-board plumbing". In many of the systems presently employed in the related art, each component often requires its own mounting strategy and associated fasteners. The on-board plumbing must be routed so as not to clutter the engine. This objective is not always met in evaporative emission systems known in the related art and they can be expensive to service. Further, and because of the ever-shrinking space available for the vehicle power plant, the effective use of space through efficient component packing is a parameter which designers must constantly seek to improve.

Thus, there remains a need in the art for an evaporative emission system which reduces the number of components needed to effectively monitor the system. Further, there is a need for such a system that reduces the complicated on-board plumbing of the type required for systems known in the related art. There is also a need in the art for an evaporative emission canister purge actuation monitoring system that is inexpensive to manufacture and easy to service in the field. Finally, there is a need in the art for an evaporative emission canister purge actuation monitoring system that has improved response time and accurate repeatability and that is smaller than present systems employed in the related art.

SUMMARY OF THE INVENTION

The present invention overcomes the deficiencies in the related art in an evaporative emission canister purge actuation monitoring system for a motor vehicle that has a vapor canister, an engine and at least one control unit. The purge actuation monitoring system of the present invention includes an integrated valve body and a cover mounted to the valve body so as to define a vent chamber between the cover and the valve body. The cover has a fresh air port providing fluid communication between the ambient air and the vent chamber. The integrated valve body includes a main flow passage and a canister port adapted to establish fluid communication between the vapor canister and the main flow passage. A first one-way umbrella valve is mounted to the integrated valve body and is responsive to a predetermined positive pressure in the main flow passage to control the flow of fluid from the vapor canister to the ambient air, through the vent chamber and to the fresh air port. In addition, a second one-way umbrella valve is mounted to the integrated valve body and responsive to a predetermined negative pressure in the main flow passage to control the flow of ambient air through the fresh air port and the vent chamber and through the main flow passage and the second canister port. The system further includes a vacuum-actuated switch supported by the integrated valve body and in electrical communication with the control unit. The switch is responsive to a predetermined negative pressure in the main flow passage to send a signal indicative of the predetermined negative pressure to the control unit.

In this way, the canister purge actuation monitoring system of the present invention reduces the number of components needed to effectively monitor the evaporative emission system as well as the complicated onboard plumbing of the type required for systems known in the related art. The system senses the presence and duration of a purge vacuum that is imposed on the vapor canister when the canister purge valve is open and also senses the presence of a leak in the evaporative emission system, to the extent this condition occurs. The evaporative emission canister purge actuation monitoring system of the present invention is inexpensive to manufacture and easy to service in the field. Moreover, it has an improved response time and accurate repeatability when compared to known systems in the related art. Finally, the evaporative emission canister purge actuation monitoring system is designed so as to present a smaller, less bulky profile. Accordingly, it is easier to "package" the evaporative emission canister purge actuation monitoring system of the present invention on the vehicle.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE INVENTION

Figure 1:
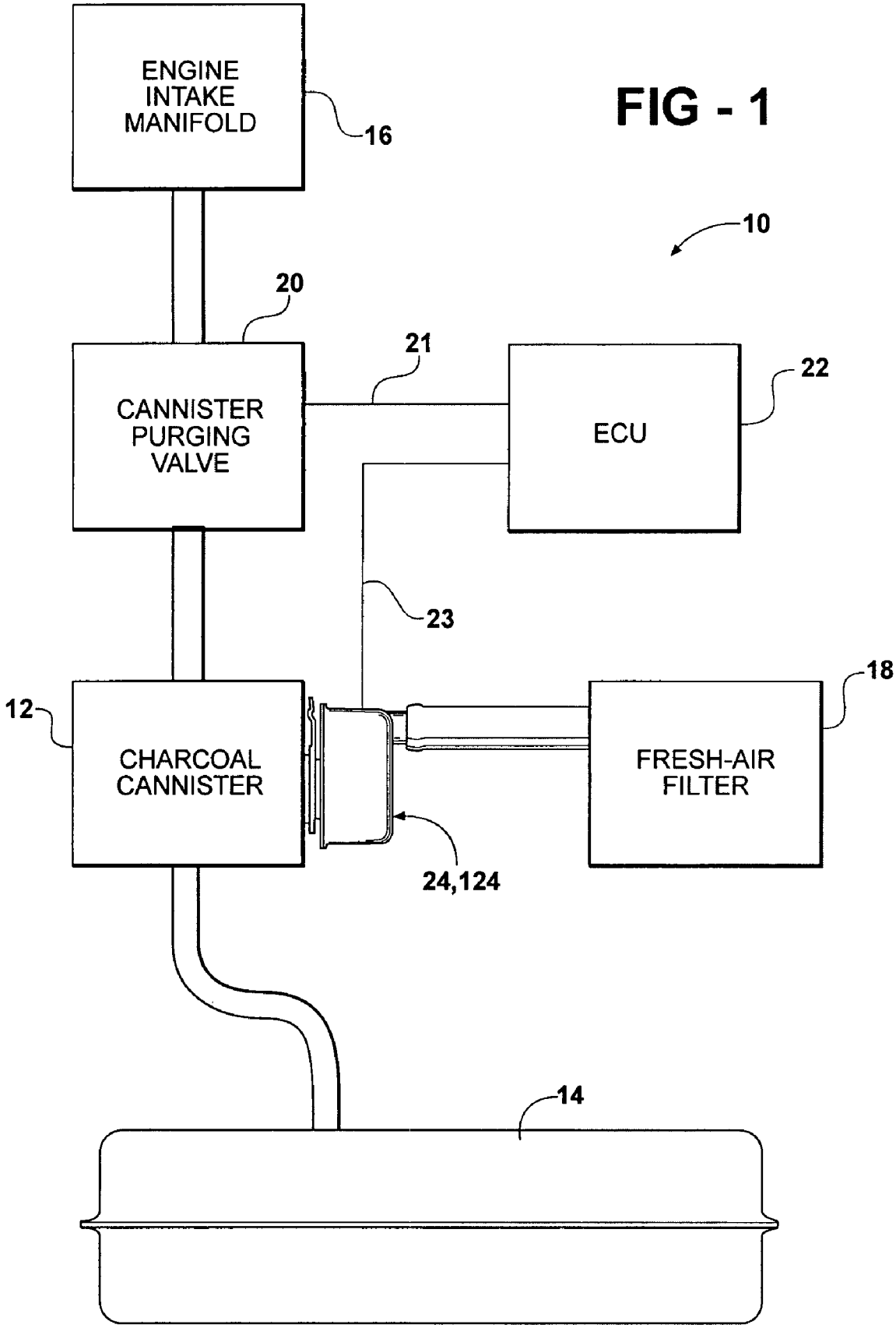
FIG. 1 is a schematic representation of an evaporative emission system of the type employing the canister purge actuation monitoring system of the present invention.
Figure 2:
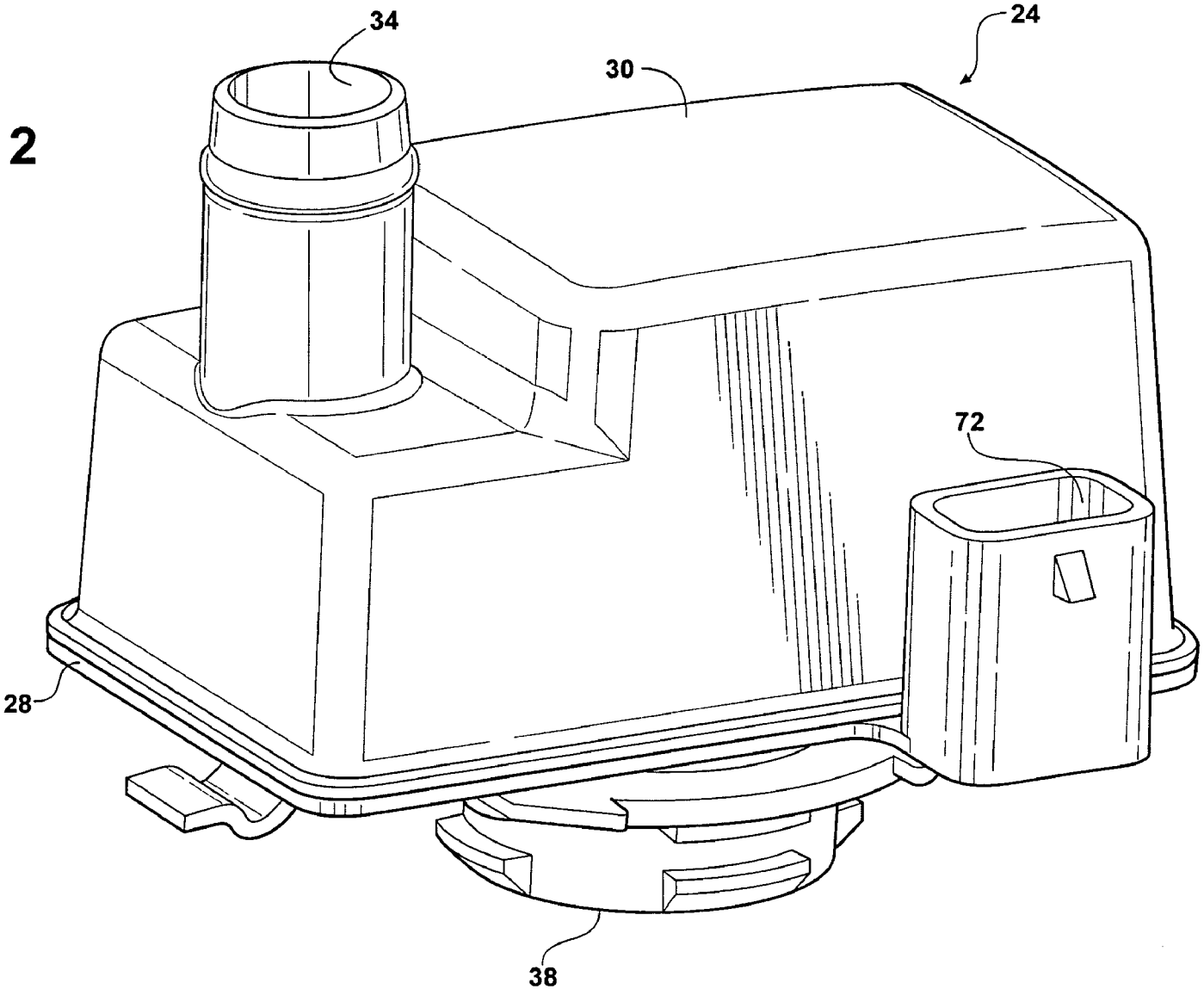
FIG. 2 is a perspective view of one embodiment of the canister purge actuation monitoring system of the present invention.

Referring now to the drawings, a representative evaporative emission system for an automotive vehicle is schematically illustrated at 10 in FIG. 1. The evaporative emission system 10 generally includes a vapor canister 12 operatively connected in fluid communication with a fuel tank 14 as well as the intake manifold 16 of the internal combustion engine. The vapor canister 12 is typically provided in fluid communication with the ambient air via a fresh air filter schematically indicated at 18 in FIG. 1. The vapor 12 canister typically includes carbon or some other absorbent material that acts to trap the volatile evaporative emissions generated by the fuel system. However, those having ordinary skill in the art will appreciate from the description that follows that the present invention is not limited to any particular type of vapor canister. A canister purge valve, generally indicated at 20, controls the flow of evaporative emissions between the vapor canister 12 and the intake 16 of the engine via an electrical connection schematically indicated at 21. In turn, the operation of the canister purge valve 20 is typically controlled by an onboard computer, such as an engine control module or engine control unit, or the like, schematically illustrated at 22. An evaporative emission canister purge actuation monitoring system of the present invention is generally indicated at 24, 124 and is operatively mounted to the vapor canister 12. Accordingly, the canister purge actuation monitoring system 24, 124 of the present invention is operatively disposed in fluid communication between the vapor canister 12 and the ambient air via the fresh air filter 18.

Referring now to FIGS. 2-6, one embodiment of the evaporative emission canister purge actuation monitoring system for a motor vehicle is generally indicated at 24, where like numerals are used to designate like components throughout the drawings. The system 24 includes an integrated valve body 26 defining a peripheral flange 28 and a cover 30 operatively supported by the peripheral flange 28 so as to define a vent chamber 32 between the cover 30 and the valve body 26. The cover 30 has a fresh air port 34 providing fluid communication between ambient air and the vent chamber 32. In the representative system 10 illustrated in FIG. 1, the fresh air port 34 is in fluid communication with the ambient air via the fresh air filter 18.

The integrated valve body 26 has a main flow passage 36 and a canister port 38 which is adapted to establish fluid communication between the vapor canister 12 and the main flow passage 36. In one preferred embodiment, the system 24 of the present invention is operatively mounted directly to the vapor canister 12 via the canister port 38 (FIG. 1). A first one-way umbrella valve is generally indicated at 40 and is mounted to the integrated valve body 26. The first one-way umbrella valve 40 is responsive to predetermined pressure in the main flow passage 36 to control the flow of fluid from the vapor canister 12 to the ambient air through the vent chamber 32 and the fresh air port 34. In addition, a second one-way umbrella valve is generally indicated at 42 and is mounted to the integrated valve body 26. The second one-way umbrella valve 42 is responsive to predetermined negative pressure in the main flow passage 36 to control the flow of ambient air through the fresh air port 34 and the vent chamber 32 and through the main flow passage 36 and the canister port 38. The system 24 further includes a vacuum actuated switch, generally indicated at 46. The switch 46 is supported by the integrated valve body 26 and is in electrical communication with the control unit 22. The switch 46 is responsive to a predetermined negative pressure in the main flow passage 36 so as to send a vehicle indicative of the predetermined negative pressure to the control unit 22 via the electrical connection schematically indicated at 23 in FIG. 1. Each of these components of the system 24 of the present invention will be described in greater detail below.

Figure 3:
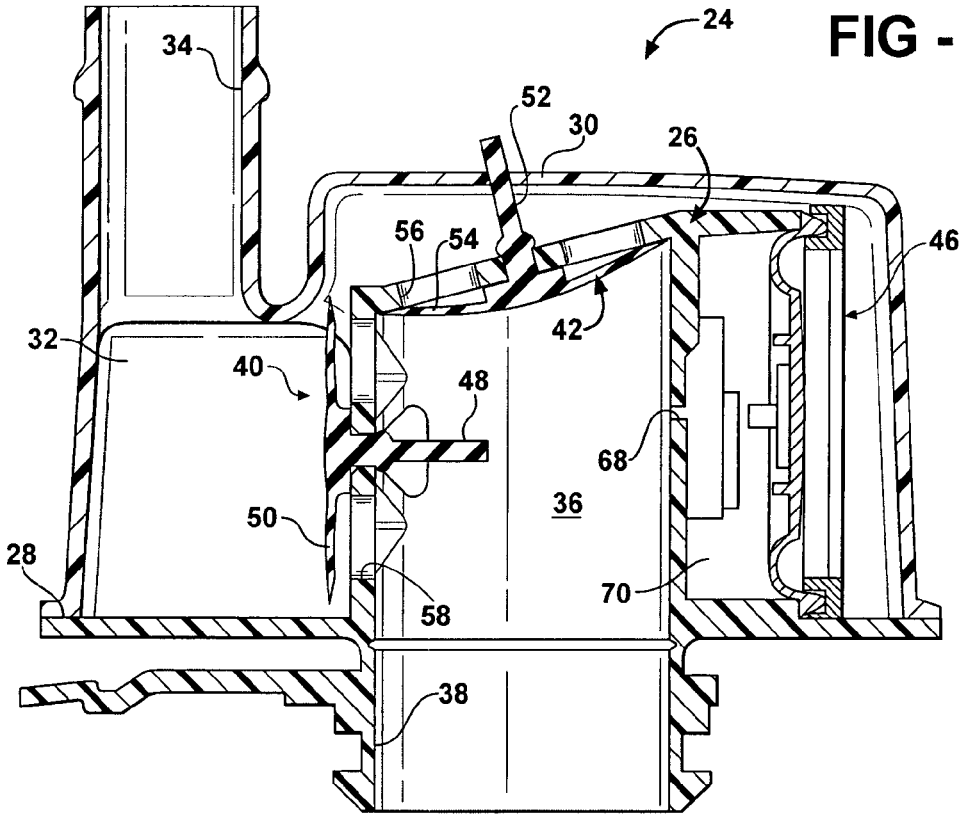
FIG. 3 is a cross-sectional side view of one embodiment of the canister purge actuation monitoring system of the present invention showing the first one-way umbrella valve disposed in the open position.
Figure 4:
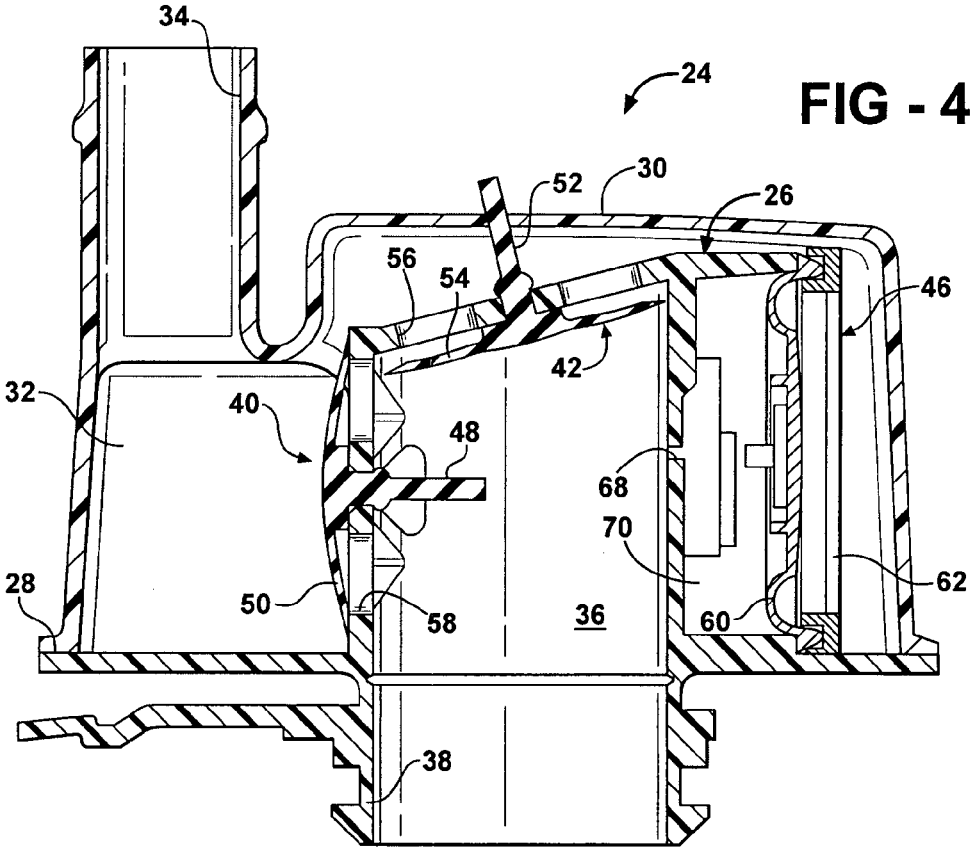
FIG. 4 is a cross-sectional side view of one embodiment of the canister purge actuation monitoring system of the present invention showing the second one-way umbrella valve disposed in the open position.
Figure 5:
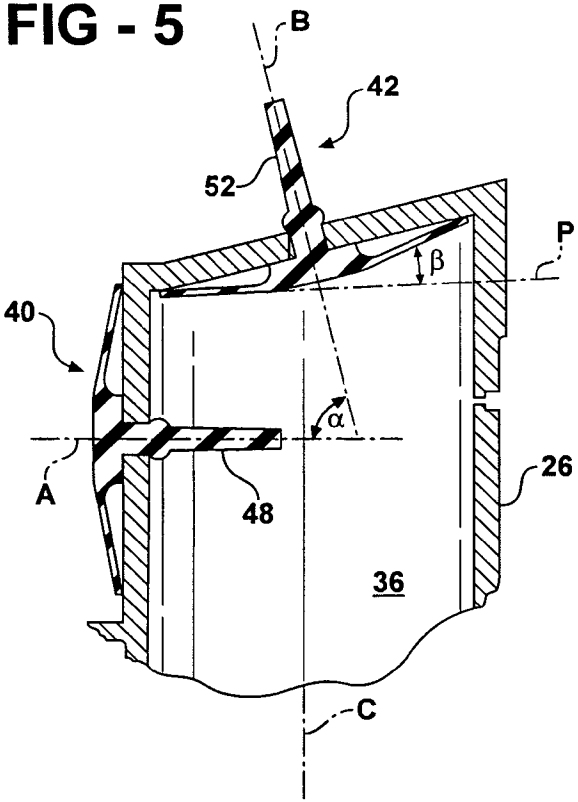
FIG. 5 is an enlarged partial cross-sectional side view of the main flow passage of the integrated valve body of one embodiment of the present invention illustrating the disposition of the first and second valves relative to each other and the main flow passage.

Referring now specifically to FIGS. 3-5, the first one-way umbrella valve 40 includes a valve stem 48 and a valve element 50. The valve element 50 is movable to control the flow of fluid, such as air between the main flow passage 36 and the vent chamber 32 (FIG. 3). The valve stem 48 of the first one-way umbrella valve 40 defines a first longitudinal axis A (FIG. 5). Similarly, the second one-way umbrella valve 42 includes a valve stem 52 and a valve element 54. The valve element 54 is movable to control the flow of fluid, such as air between the main flow passage 36 and the vent chamber 32 (FIG. 4). The valve stem 52 of the second one-way umbrella valve defines a second longitudinal axis B. As best shown in FIG. 5, the first and second longitudinal axes A and B of the first and second one-way umbrella valves 40 and 42 are disposed at an acute angle α relative to one another.

The main flow passage 36 defines a longitudinal axis C and a canister purge port 56. The second one-way umbrella valve 42 is mounted in the integrated valve body 26 so as to control the flow of fluid through the canister purge port 56. The canister purge port 56 defines an acute angle β relative to a plane P extending perpendicular to the longitudinal axis C of the main flow passage 36 (FIG. 5). The main flow passage 36 also defines a vent port 58. The first one-way umbrella valve 40 is mounted to the integrated valve body 26 so as to control the flow of fluid through the vent port 58 as will be described in greater detail below.

Figure 6:
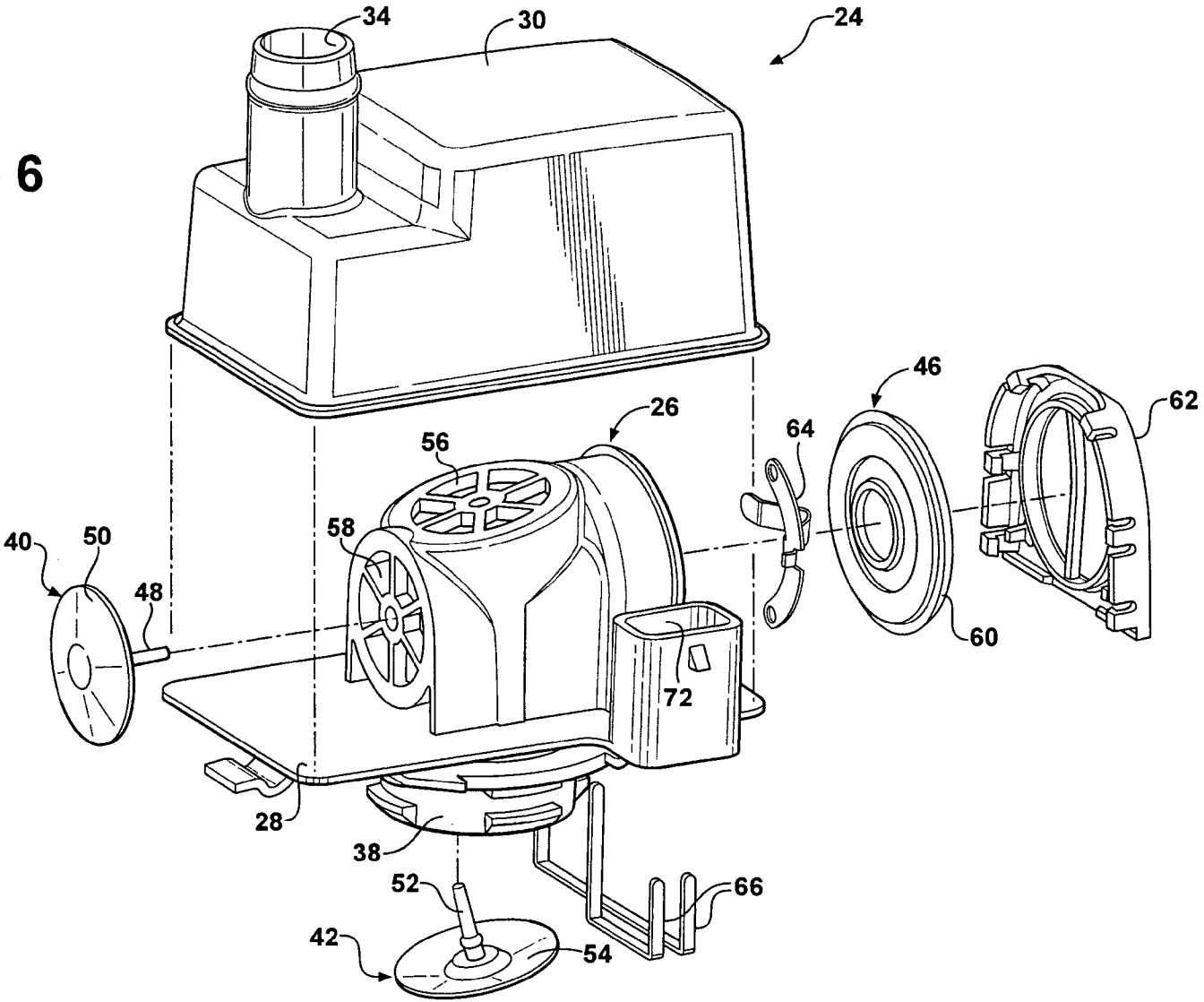
FIG. 6 is an exploded perspective view of one embodiment of the purge canister actuation monitoring system of the present invention illustrated in FIGS. 2-4.

The vacuum actuated switch 46 includes a diaphragm 60 that is operatively supported by a retainer 62. The retainer 62 is mounted to the integrated valve body 26. As best shown in FIG. 6, the switch 46 further includes a flexible switch element 64 and a pair of terminals 66 supported by the integrated valve body 26. The switch element 64 is responsive to movement of the diaphragm 60 to connect the pair of terminals 66 in response to a predetermined negative pressure in the main flow passage 36 as will be described in greater detail below. To this end, the main flow passage 36 includes a small vacuum switch port 68 that provides fluid communication between a vacuum switch chamber 70 and the main flow passage 36. The integrated valve body 26 further includes a switch connector 72 that provides electrical communication between the switch element 64 and the control unit 22. The operation of the vacuum actuated switch 46 as well as the first and second one-way umbrella valves 40, 42 will be described in greater detail below.

Figure 9:
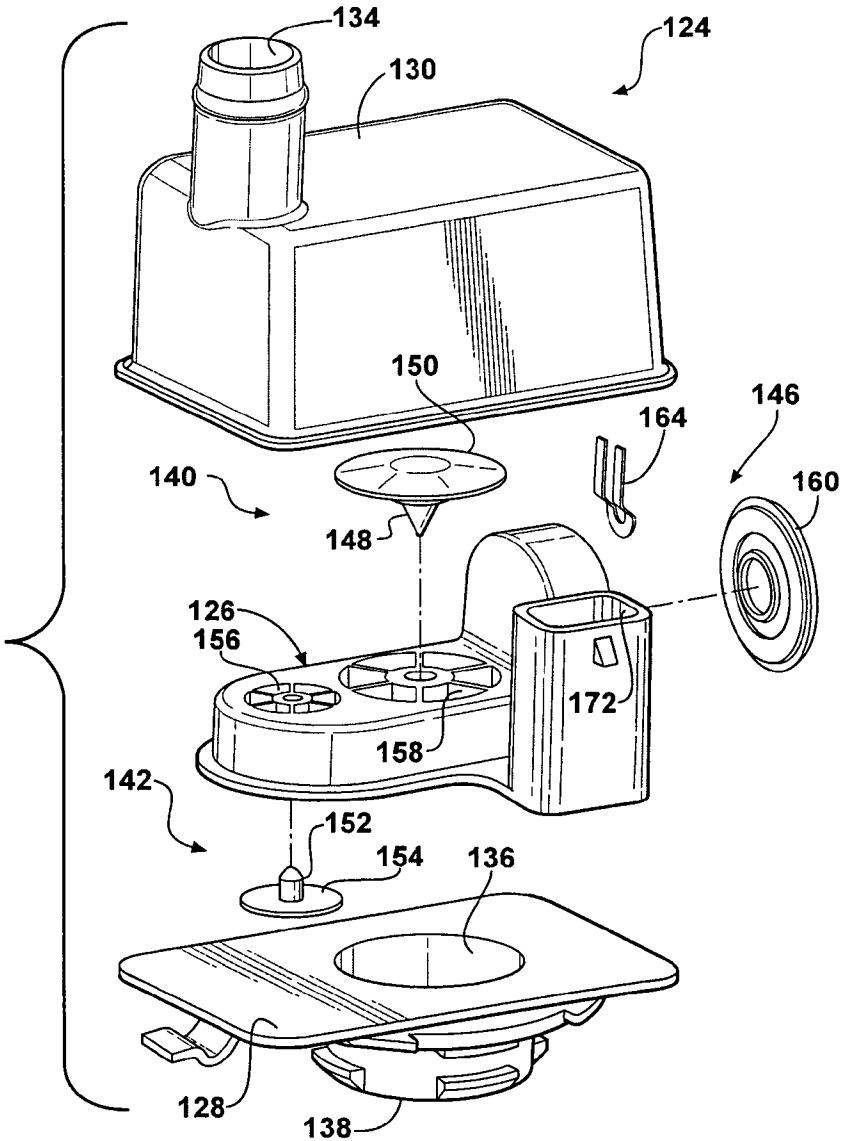
FIG. 9 is an exploded perspective view of the second embodiment of the purge canister actuation monitoring system of the present invention illustrated in FIGS. 7-8.
Figure 7:
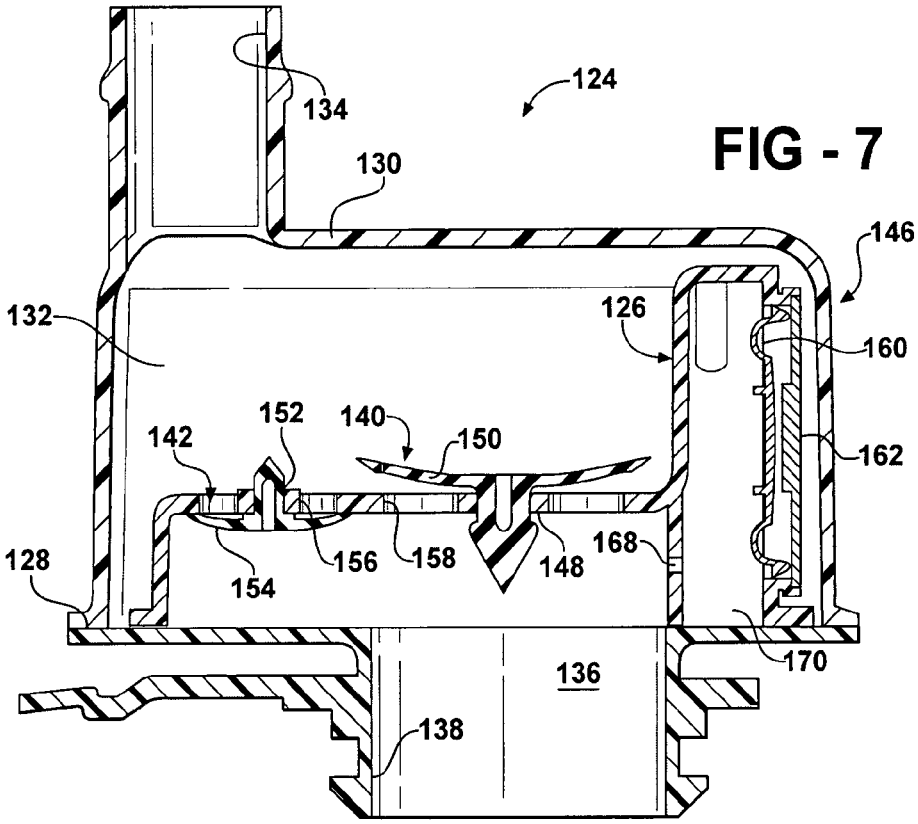
FIG. 7 is a cross-sectional side view of another embodiment of the canister purge actuation monitoring system of the present invention showing the first one-way umbrella valve disposed in the open position.
Figure 8:
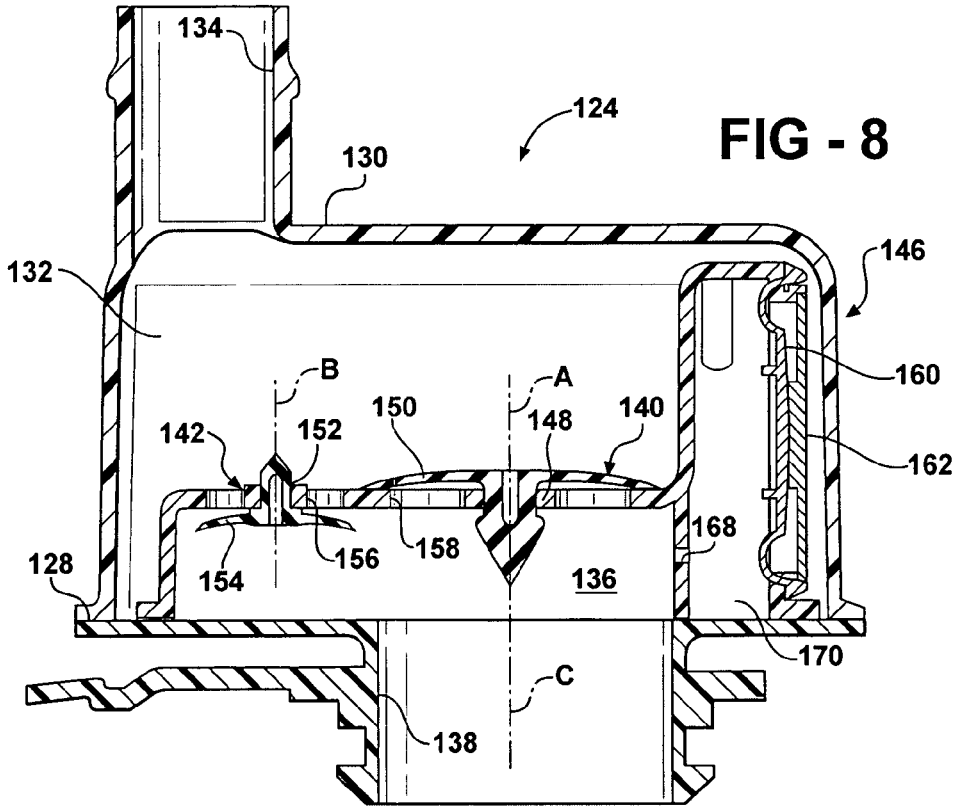
FIG. 8 is a cross-sectional side view of another embodiment of the canister purge actuation monitoring system of the present invention showing the second one-way umbrella valve disposed in the open position.

Another embodiment of the evaporative emission canister purge actuation monitoring system for a motor vehicle is generally indicated at 124 in FIGS. 7-9, where like numerals increased by 100 are used to designate like components described with respect to the first embodiment illustrated in FIGS. 2-6. The second embodiment 124 is similar to the first embodiment 24 illustrated in FIGS. 2-6. Accordingly, the second embodiment 124 includes an integrated valve body 126 defining a peripheral flange 128 and a cover 130 operatively supported by the peripheral flange 128 so as to define a vent chamber 132 between the cover 130 and the valve body 126. The cover 130 has a fresh air port 134 providing fluid communication between ambient air and the vent chamber 132. In the representative system 10 illustrated in FIG. 1, the fresh air port 134 is in fluid communication with the ambient air via the fresh air filter 18.

The integrated valve body 126 has a main flow passage 136 and a canister port 138 which is adapted to establish fluid communication between the vapor canister 12 and the main flow passage 136. In one preferred embodiment, the system 124 of the present invention is operatively mounted directly to the vapor canister 12 via the canister port 138 (FIG. 1). A first one-way umbrella valve is generally indicated at 140 and is mounted to the integrated valve body 126. The first one-way umbrella valve 140 is responsive to predetermined pressure in the main flow passage 136 to control the flow of fluid from the vapor canister 12 to the ambient air through the vent chamber 132 and the fresh air port 134. In addition, a second one-way umbrella valve is generally indicated at 142 and is mounted to the integrated valve body 126. The second one-way umbrella valve 142 is responsive to predetermined negative pressure in the main flow passage 136 to control the flow of ambient air through the fresh air port 134 and the vent chamber 132 and through the main flow passage 136 and the canister port 138. The system 124 further includes a vacuum actuated switch, generally indicated at 146. The switch 146 is supported by the integrated valve body 126 and is in electrical communication with the control unit 22. The switch 146 is responsive to a predetermined negative pressure in the main flow passage 136 so as to send a vehicle indicative of the predetermined negative pressure to the control unit 22 via an electrical connection schematically indicated at 23 in FIG. 1. Each of these components of the system 124 of the present invention will be described in greater detail below.

With continuing reference to FIGS. 7-9, the first one-way umbrella valve 140 includes a valve stem 148 and a valve element 150. The valve stem 148 of the first one-way umbrella valve 140 defines a first longitudinal axis A. Similarly, the second one-way umbrella valve 142 includes a valve stem 152 and a valve element 154. The valve stem 152 of the second one-way umbrella valve 142 defines a second longitudinal axis B. In contrast to the first embodiment illustrated in FIGS. 2-6, the first and second longitudinal axis A and B of the first and second one-way umbrella valves 140 and 142 are disposed spaced and parallel to each other. This configuration results in a main flow passage 136 with a lower profile when compared to the main flow passage 36 illustrated in FIGS. 2-6.

The main flow passage 136 defines a longitudinal axis C and a canister purge port 156. A second one-way umbrella valve 142 is mounted in the integrated valve body 126 so as to control the flow of fluid through the canister purge port 156 (FIG. 8). The main flow passage 136 also defines a vent port 158. First one-way umbrella valve 140 is mounted to the integrated valve body 126 so as to control the flow of fluid through the vent port 158 as will be described in greater detail below (FIG. 7). In the embodiment illustrated in FIGS. 7 and 8, the first longitudinal axis A of the first one-way umbrella valve 140 is coaxial with the longitudinal axis C of the main flow passage 136. In addition, the second longitudinal axis B of the second one-way umbrella valve 142 is disposed in spaced parallel relationship with respect to the coaxial axes A and C.

The vacuum actuated switch 146 includes a diaphragm 160 that is operatively supported by a retainer 162. The retainer 162 is mounted to the integrated valve body 126. The switch 146 further includes a flexible switch element 164 and a pair of terminals supported by the integrated valve body 126 (FIG. 9). The switch element 164 is responsive to movement of the diaphragm 160 to connect the pair of terminals in response to a predetermined negative pressure in the main flow passage 136 as will be described in greater detail below. To this end, the main flow passage 136 includes a small vacuum switch port 168 that provides fluid communication between a vacuum switch chamber 170 and the main flow passage 136. The integrated valve body 126 further includes a switch connector 172 that provides electrical communication between the switch element 164 and the control unit 22 via the electrical line 23 (FIG. 1).

The operation of the evaporative emission canister purge actuation monitoring systems 24, 124 as well as all subcomponents described above is identical. Accordingly, the function of the system of the present invention will be described in relation to the components of the system 24 illustrated in FIGS. 2-6. Those having ordinary skill in the art will appreciate that the description that follows applies equally with respect to the components illustrated in FIGS. 7-9, where like numerals increased by 100 have been used to describe like components.

As noted above, evaporative emissions generated by the gasoline fuel may be collected in the vapor canister 12. Air that has been stripped of the volatile gasses may pass through the vapor canister 12 into the evaporative emission canister purge actuation monitoring system 24 of the present invention. When the positive pressure of the evaporative emissions exceed a predetermined level, the valve element 50 of the first one-way umbrella valve 40 will move to open the vent port 58. This operative condition is illustrated in FIGS. 3 and 7. Air under the influence of this positive pressure will flow into the vent chamber 32, through the fresh air port 34 and into the air filter 18.

It is possible for the absorbent material, such as carbon, used in the vapor canister 12 to become saturated with volatile vapors. Accordingly, the vapor canister 12 must be periodically purged. This purging process must be controlled. Accordingly, during certain predetermined periods of engine operation, the engine control unit 22 signals the canister purge valve 20 to open thereby subjecting the vapor canister 12 to a vacuum generated at the engine via the intake manifold 16. When the purge valve 20 is opened, the evaporative emission canister purge actuation monitoring system 24 is also subject to the vacuum generated by the engine via the intake manifold 16. This causes fresh air to flow from the air filter 18 through the fresh air port 34, into the vent chamber 32 and past the valve element 54 of the second one-way umbrella valve 42. This operative condition is illustrated in FIGS. 4 and 8. Fresh air then flows through the main flow passage 36, through the canister port 38 and into the vapor canister 12. This negative pressure causes volatile gasses trapped in the vapor canister to be released and flow into the intake manifold of the engine. Purging the vapor canister 12 affects the air/fuel ratio entering the combustion chamber of the engine. Accordingly, this purging process must be monitored and controlled. The vacuum actuated switch 46 of the present invention serves this purpose.

To this end, the vacuum switch port 68 is calibrated such that the vacuum actuated switch 46 triggers once the vacuum generated during the vapor canister purge process has reached a predetermined level. More specifically, the vacuum switch port 68 communicates with both the main flow passage 36 and the vacuum switch chamber 70. The vacuum switch port 68 is subject to the purge vacuum that exists in the main flow passage 36 and is sized so that the diaphragm 60 moves the switch element 64 into contact with the pair of terminals 66 such that the switch 46 is triggered at a predetermined negative pressure. The switch 46 is connected in electrical communication with the engine control unit 22. When it triggers, the switch 46 sends a signal to the engine control unit 22. The engine control unit 22 uses this information to send a signal closing the canister purge valve 20. The vacuum switch port 68 is also calibrated in size to detect if any leaks are present in the evaporative emission system. If the switch 46 does not trigger in a predetermined period of time after the canister purge valve 20 has been opened, this indicates there exists a leak of a size greater than the vacuum switch port 68. Thus, the evaporative emission canister purge actuation monitoring system 24, 124 of the present invention thus serves a leak detection function for the vehicle evaporative emission system.

In this way, the canister purge actuation monitoring system of the present invention reduces the number of components needed to effectively monitor the evaporative emission system as well as the complicated onboard plumbing of the type required for systems known in the related art. The system senses the presence and duration of a purge vacuum that is imposed on the vapor canister when the canister purge valve is open and also senses the presence of a leak in the evaporative emission system, to the extent this condition occurs. The evaporative emission canister purge actuation monitoring system of the present invention is inexpensive to manufacture and easy to service in the field. Moreover, it has an improved response time and accurate repeatability when compared to known systems in the related art. Finally, the evaporative emission canister purge actuation monitoring system is designed so as to present a smaller, less bulky profile. Accordingly, it is easier to "package" the evaporative emission canister purge actuation monitoring system of the present invention in the engine compartment.

What is claimed is:

1. An evaporative emission canister purge actuation monitoring system for a motor vehicle having a vapor canister, an engine, and at least one control unit said system comprising:

an integrated valve body and a cover mounted to said valve body so as to define a vent chamber between the cover and the valve body, said cover having a fresh air port providing fluid communication between ambient air and said vent chamber;

said integrated valve body having a main flow passage and a canister port adapted to establish fluid communication between the vapor canister and said main flow passage;

a first one-way umbrella valve mounted to said integrated valve body and responsive to a predetermined positive pressure in said main flow passage to control the flow of fluid from the vapor canister to the ambient air through said vent chamber and said fresh air port;

a second one-way umbrella valve mounted to said integrated valve body and responsive to a predetermined negative pressure in said main flow passage to control the flow of ambient air through said fresh air port and said vent chamber and through said main flow passage and said canister port; and a vacuum actuated switch supported by said integrated valve body and in electrical communication with the control unit, said switch including a diaphragm operatively supported by a retainer with said retainer mounted to said integrated valve body, a flexible switch element and a pair of terminals supported by said integrated valve body, said switch element responsive to movement of said diaphragm to connect said pair of terminals in response to a predetermined negative pressure in said main flow passage to send a signal indicative of the predetermined negative pressure to the control unit.

2. An evaporative emission canister purge actuation monitoring system as set forth in claim 1 wherein said integrated valve body includes a peripheral flange, said cover operatively supported by said peripheral flange so as to define said vent chamber.

3. An evaporative emission canister purge actuation monitoring system as set forth in claim 1 wherein said first one-way umbrella valve defines a first longitudinal axis and said second one-way umbrella valve defines a second longitudinal axis wherein said first and second longitudinal axes are disposed at an acute angle relative to one another.

4. An evaporative emission canister purge actuation monitoring system as set forth in claim 3 wherein said main flow passage defines a longitudinal axis and a canister purge port, said second one-way umbrella valve mounted in said integrated valve body so as to control the flow of fluid through said canister purge port, said canister purge port defining an acute angle relative to a plane extending perpendicular said longitudinal axis of said main flow passage.

5. An evaporative emission canister purge actuation monitoring system as set forth in claim 4 wherein said main flow passage defines a vent port, said first one-way umbrella valve mounted to said integrated valve body so as to control the flow of fluid through said vent port.

6. An evaporative emission canister purge actuation monitoring system as set forth in claim 1 wherein said first one-way umbrella valve defines a first longitudinal axis and said second one-way umbrella valve defines a second longitudinal axis, wherein said first and second longitudinal axes are disposed spaced and parallel to each other.

7. An evaporative emission canister purge actuation monitoring system as set forth in claim 1 wherein said integrated valve body includes a switch connector providing electrical communication between said switch element and the control unit.

* * * * *